US008009124B2

(12) United States Patent
Kim

(10) Patent No.: US 8,009,124 B2
(45) Date of Patent: Aug. 30, 2011

(54) PLASMA DISPLAY AND DRIVING METHOD THEREOF

(75) Inventor: Tae-Hyun Kim, Suwon-si (KR)

(73) Assignee: Samsung SDI Co., Ltd., Gongse-dong, Giheung-gu, Yongin-si, Gyeonggi-do (KR)

( * ) Notice: Subject to any disclaimer, the term of this patent is extended or adjusted under 35 U.S.C. 154(b) by 932 days.

(21) Appl. No.: 11/979,938

(22) Filed: Nov. 9, 2007

(65) Prior Publication Data

US 2008/0117140 A1 May 22, 2008

(30) Foreign Application Priority Data

Nov. 22, 2006 (KR) ..... 10-2006-0115933

(51) Int. Cl.
*G09G 3/28* (2006.01)

(52) U.S. Cl. ..... 345/67; 345/60

(58) Field of Classification Search ..... 345/66–68
See application file for complete search history.

(56) References Cited

U.S. PATENT DOCUMENTS

| | | | | |
|---|---|---|---|---|
| 6,084,558 | A * | 7/2000 | Setoguchi et al. | 345/60 |
| 6,107,975 | A | 8/2000 | Nagaoka et al. | |
| 6,320,560 | B1 * | 11/2001 | Sasaki et al. | 345/60 |
| 7,518,576 | B1 * | 4/2009 | Rutherford | 345/60 |
| 2002/0063662 | A1 | 5/2002 | Nagakubo et al. | |
| 2009/0295784 | A1 * | 12/2009 | Kwon et al. | 345/213 |

FOREIGN PATENT DOCUMENTS

| | | | |
|---|---|---|---|
| CN | 1804905 | A | 7/2000 |
| CN | 1698081 | A | 11/2005 |
| CN | 1848358 | A | 10/2006 |
| EP | 1271463 | A2 | 1/2003 |
| EP | 1519354 | A2 | 3/2005 |
| JP | 09-179520 | | 7/1997 |
| JP | 2001-337647 | | 12/2001 |
| JP | 2002-132209 | | 5/2002 |
| JP | 2002-251165 | | 9/2002 |
| JP | 2002251165 | A | 9/2002 |
| JP | 2003-076319 | | 3/2003 |
| JP | 2005-092221 | | 4/2005 |
| KR | 10-2005010094 | | 10/2005 |
| KR | 10-2005-0118855 | | 12/2005 |
| KR | 10-0560457 | B1 | 3/2006 |

OTHER PUBLICATIONS

The European Search Report issued by European Patent ofice on Aug. 20, 2009 in the corresponding European Patent Application No. 07120755.9.

Japanese Notice of Allowance issued by JIPO dated Nov. 9, 2010 corresponding to Japanese Patent Application No. 2007-278033, together with a Request for Entry.

European Office Action Application No. 07 120 755.9, issued by European Patent Office on Feb. 11, 2011.

* cited by examiner

*Primary Examiner* — Kevin Nguyen
*Assistant Examiner* — Sepideh Ghafari
(74) *Attorney, Agent, or Firm* — Robert E. Bushnell, Esq.

(57) ABSTRACT

A plasma display and a driving method for the plasma display. The plasma display is constructed with a control type plasma display panel having a closed barrier rib configuration, and each pair of column-wise neighboring discharge cells have different electrode arrangement. In the driving method, when the control type plasma display panel has an alignment error for a first electrode and a second electrode, a scan pulse having a first width is applied to an odd-numbered first electrode, and the scan pulse having a second width that is different from the first width is applied to an even-numbered first electrode.

10 Claims, 11 Drawing Sheets

PLASMA DISPLAY AND DRIVING METHOD THEREOF

CLAIM OF PRIORITY

This application makes reference to, incorporates the same herein, and claims all benefits accruing under 35 U.S.C. §119 from an application for PLASMA DISPLAY DEVICE AND DRIVING METHOD THEREOF earlier filed in the Korean Intellectual Property Office on 22 Nov. 2006 and there duly assigned Serial No. 10-2006-0115933.

BACKGROUND OF THE INVENTION

1. Field of the Invention

The present invention relates to a plasma display and a method for driving a plasma display.

2. Description of the Related Art

A plasma display is a display device employing a plasma display panel (PDP) configured to display moving characters and/or video images using plasma generated by means of gas discharge, and the plasma display has a higher luminance, a higher luminous efficiency and a wider viewing angle compared to other displays. Accordingly, the plasma display is being highlighted as a substitute for conventional cathode ray tubes (CRTs) for large-screen displays of more than 40 inches.

Generally, a plasma display panel (PDP) of the plasma display includes a plurality of address electrodes (hereinafter referred to as "A electrodes") extending in a column direction, and a plurality of sustain and scan electrodes (hereinafter respectively referred to as "X electrodes" and "Y electrodes") in pairs extending in a row direction. The A electrodes are formed to cross the X and Y electrodes. A configuration in which the X electrodes and Y electrodes are sequentially arranged in a column direction is referred to as an "XYXY arrangement configuration". Here, a space formed at the crossing region of the A, X, and Y electrodes forms a discharge cell.

A resolution of the plasma display is determined according to the number of discharge cells formed in the PDP, and the PDP is now being developed to increase the resolution in order to realize high-definition.

To achieve the high-definition, it is required to reduce the size of the discharge cell formed in the PDP to increase the number of discharge cells. The total capacitance increases, however, as the number of discharge cells increases, and the discharge efficiency decreases as the size of discharge cells decreases.

Accordingly, an XY arrangement configuration formed by varying the XYXY configuration has been developed and used to solve the problem of the increase of capacitance by the high-definition, and a phosphor coating area is increased by using a closed barrier rib configuration of the discharge cell to compensate the discharge efficiency. In the closed barrier rib configuration, neighboring discharge cells are partitioned by barrier ribs, and in further detail, one discharge cell is surrounded by the barrier rib.

In the PDP having the closed barrier rib configuration (hereinafter referred to as a "closed barrier rib configuration") and different electrode configurations between the neighboring discharge cells (i.e., arrangement configurations of the X and Y electrodes) in the new XY arrangement configuration, however, a Y electrode area of the discharge cell positioned in one line selected from even and odd lines is less than a Y electrode area of the discharge cell positioned in another line when an alignment error for the X and Y electrodes occurs.

Therefore, when the same scan pulse is applied during an address period, a normal address discharge is generated in the discharge cell of the greater Y electrode area, but a low discharge or a misfire may be generated in the discharge cell of the lesser Y electrode area.

The above information disclosed in this Background section is only for enhancement of understanding of the background of the invention and therefore it may contain information that does not form the prior art that is already known in this country to a person of ordinary skill in the art.

SUMMARY OF THE INVENTION

It is therefore an object of the present invention to provide an improved plasma display and an improved method for driving the plasma display.

It is another object of the present invention to provide a plasma display for preventing a low discharge or a misfire in a control type plasma display panel (PDP) having an alignment error during an address period, and to provide a driving method for the plasma display.

According to one aspect of the present invention, the plasma display is constructed with a control type PDP having a closed barrier rib configuration. The control type PDP is constructed with a plurality of first and second electrodes, a plurality of third electrodes formed crossing the first and second electrodes, and a plurality of discharge cells formed at the crossing regions of the first, second, and third electrodes. Each pair of column-wise neighboring discharge cells have different electrode arrangement configurations. In the driving method, a scan pulse having a first width is applied to the odd-numbered first electrodes, and the scan pulse having a second width that is different from the first width is applied to the even-numbered first electrodes.

According to another aspect of the present invention, an plasma display is constructed with a control type plasma display panel (PDP), a controller, and a first electrode driver. The control type PDP has a closed barrier rib configuration. Each pair of column-wise neighboring discharge cells have different electrode arrangement configurations. The control type PDP is constructed with a plurality of first and second electrodes, a plurality of third electrodes formed crossing the first and second electrodes, and a plurality of discharge cells formed at crossing regions of the first, second, and third electrodes. The controller divides one frame into a plurality of subfields and each subfield includes a reset period, an address period, and a sustain period, and drives the subfields. The first electrode driver generates a scan pulse according to a control operation of the controller, and applies the scan pulse to the plurality of first electrodes during the address period. The first electrode driver applies the scan pulse having a first width among the scan pulses to the odd-numbered first electrodes, and applies the scan pulse having a second width that is different from the first width to the even-numbered first electrodes.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
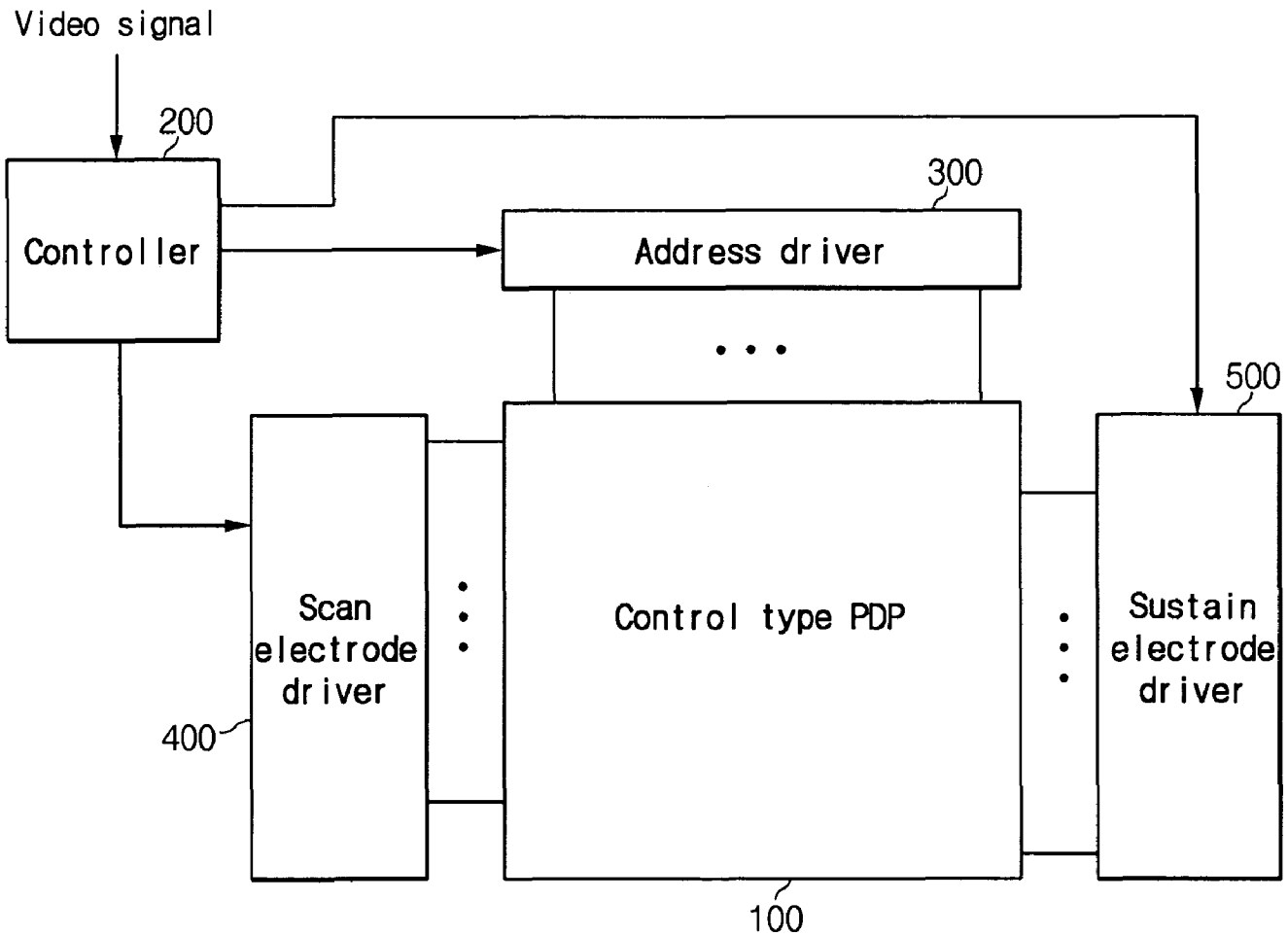
FIG. 1 shows a diagram of a plasma display constructed as an exemplary embodiment according to the principles of the present invention.

In the following detailed description, only certain exemplary embodiments of the present invention have been shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive. Like reference numerals designate like elements throughout the specification.

A plasma display constructed as an exemplary embodiment according to the principles of the present invention and a driving method thereof will be described with reference to the figures.

FIG. 1 shows a diagram of the plasma display constructed as the exemplary embodiment of the present invention. As shown in FIG. 1, the plasma display according to the exemplary embodiment of the present invention is constructed with a control type plasma display panel (PDP) 100, a controller 200, an address driver 300, a scan electrode driver 400, and a sustain electrode driver 500.

Control type PDP 100 is constructed with a plurality of address electrodes (i.e., A electrodes) extending in a column direction and a plurality of sustain electrodes (i.e., "X electrodes") and scan electrodes (i.e., "Y electrodes") extending in a row direction. The X electrodes are formed in respective correspondence to the Y electrodes, and the ends of the X electrodes are electrically coupled in common. A discharge space at a crossing region of the A electrode and the X and Y electrodes forms a discharge cell. A barrier rib is provided between neighboring discharge cells. The neighboring discharge cells have different electrode configurations. Respective electrode arrangement configurations of the control type PDP and a configuration of the discharge cell will be described later in the specification.

Controller 200 divides one frame into a plurality of subfields respectively having weights to express gray scales. Accordingly, controller 200 receives external video signals, and outputs an address driving control signal, a sustain electrode driving control signal, and a scan electrode driving control signal. In this case, when there is no alignment error in arrangement of the X and Y electrodes of control type PDP 100, controller 200 outputs the scan electrode driving control signal for controlling a scan pulse applied to the plurality of Y electrodes during an address period such that the scan pulse is an established normal pulse. When there is an error in the arrangement of the X and Y electrodes of control type PDP 100, however, controller 200 outputs the scan electrode driving control signal for controlling a width of the scan pulse of an even or odd line among the scan pulses applied to the plurality of Y electrodes during the address period such that the width of the scan pulse of the even or odd line is greater than that of the normal scan pulse.

After receiving the address driving control signal from controller 200, address driver 300 applies a display data signal to the respective A electrodes for selecting discharge cells to be displayed.

Scan electrode driver 400 generates a driving waveform according to the scan electrode driving control signal received from controller 200, and applies the driving waveform to the Y electrodes. In this case, scan electrode driver 400 increases the width of the scan pulse applied to one line from among the even and odd lines when control type PDP 100 has the alignment error.

Sustain electrode driver 500 generates a driving waveform according to the sustain electrode driving control signal received from controller 200, and applies the driving waveform to the X electrodes.

The control type PDP of the plasma display according to the exemplary embodiment of the present invention will be described with reference to FIG. 2 to FIG. 6.

As described above, each pair of column-wise neighboring discharge cells have different electrode arrangement configurations, and the barrier rib of the discharge cell has a closed barrier rib configuration.

Firstly, the different electrode arrangement configurations will be described with reference to FIG. 2 and FIG. 3.

Figure 2:
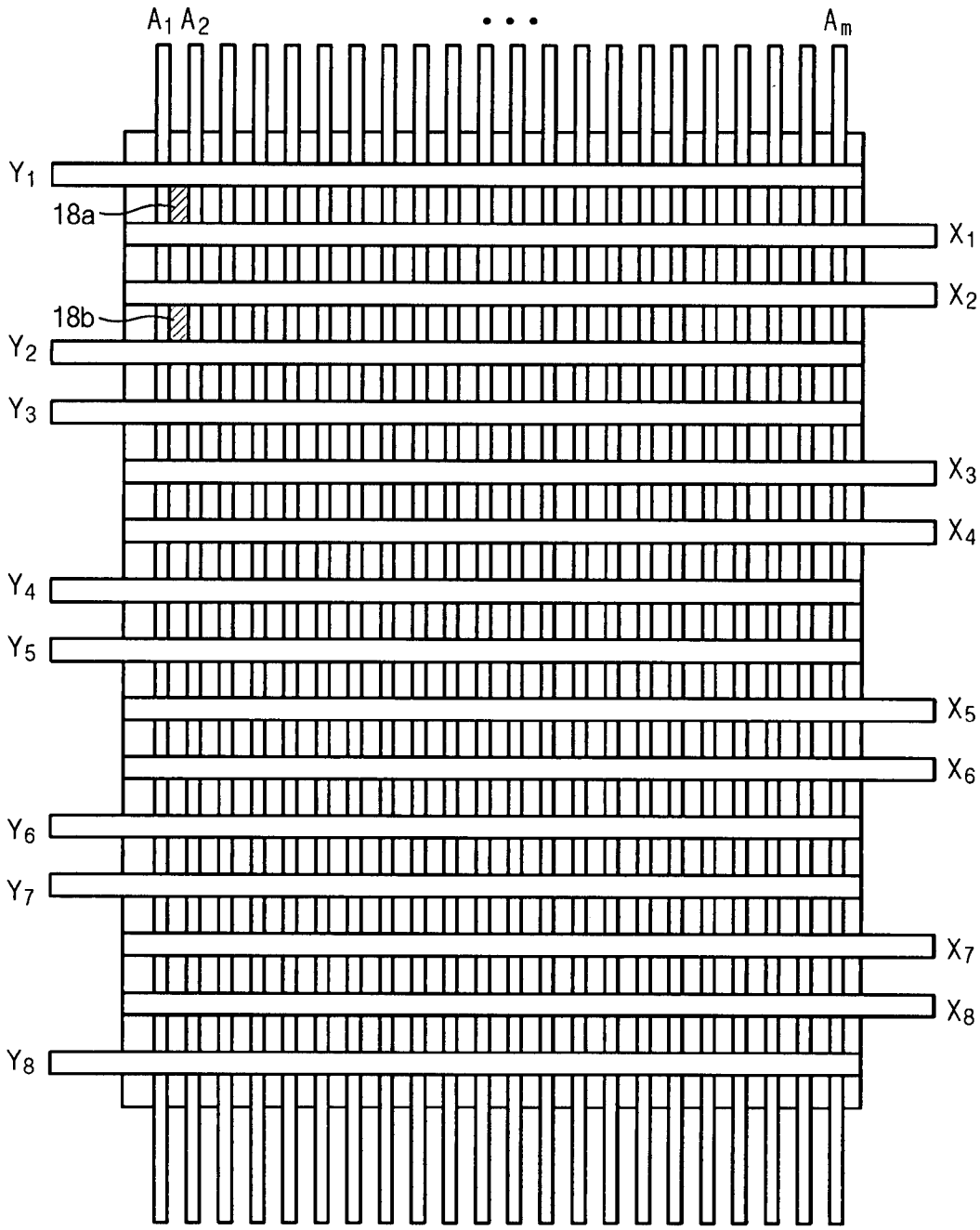
FIG. 2 shows a diagram of a control type plasma display panel (PDP) constructed as a first embodiment of discharge cell configuration according to the principles of the present invention.

FIG. 2 shows a diagram of a configuration of the control type PDP constructed as a first exemplary embodiment according to the principles of the present invention. The control type PDP shown in FIG. 2 is constructed with a plurality of address electrodes A1, A2, . . . , and Am in a column direction. Pairs of X electrodes and pairs of Y electrodes are alternately arranged on the panel, with Y electrodes Y1 and Y8 being respectively formed on the outmost sides of the X and Y electrodes. Generally, an arrangement configuration of the X and Y electrodes shown in FIG. 2 is referred to as a "XXYY arrangement configuration".

In the XXYY arrangement configuration, one discharge cell 18 is formed at a crossing region of the Y electrode, the X electrode, and the A electrode.

In FIG. 2, two neighboring discharge cells 18*a* and 18*b* are denoted by their reference numeral to compare configurations of the neighboring discharge cells. Y electrode Y1 is provided on the upper side of upper discharge cell 18*a* and X electrode X1 is provided on the lower side of upper discharge cell 18*a*. Further, X electrode X2 is provided on the upper side of lower discharge cell 18*b* and Y electrode Y2 is provided on the lower side of lower discharge cell 18*b*. That is, the two neighboring cells may have different configurations.

Another example of the neighboring discharge cell configurations will be described with reference to FIG. 3. FIG. 3 shows a diagram of a configuration of the control type PDP constructed as a second exemplary embodiment according to the principles of the present invention. The control type PDP shown in FIG. 3 is constructed with the plurality of address electrodes A1, A2, . . . , and Am in a column direction. Single X electrodes and pairs of Y electrodes are alternately arranged on the panel, with Y electrodes Y1 and Y8 being respectively formed on the outmost sides of the X and Y electrodes. Generally, an arrangement configuration of the X and Y electrodes shown in FIG. 3 is referred to as an "XYY arrangement configuration".

In this electrode arrangement configuration, each discharge cell 18 is formed at the crossing region of the Y electrode, the X electrode, and the A electrode.

Figure 3:
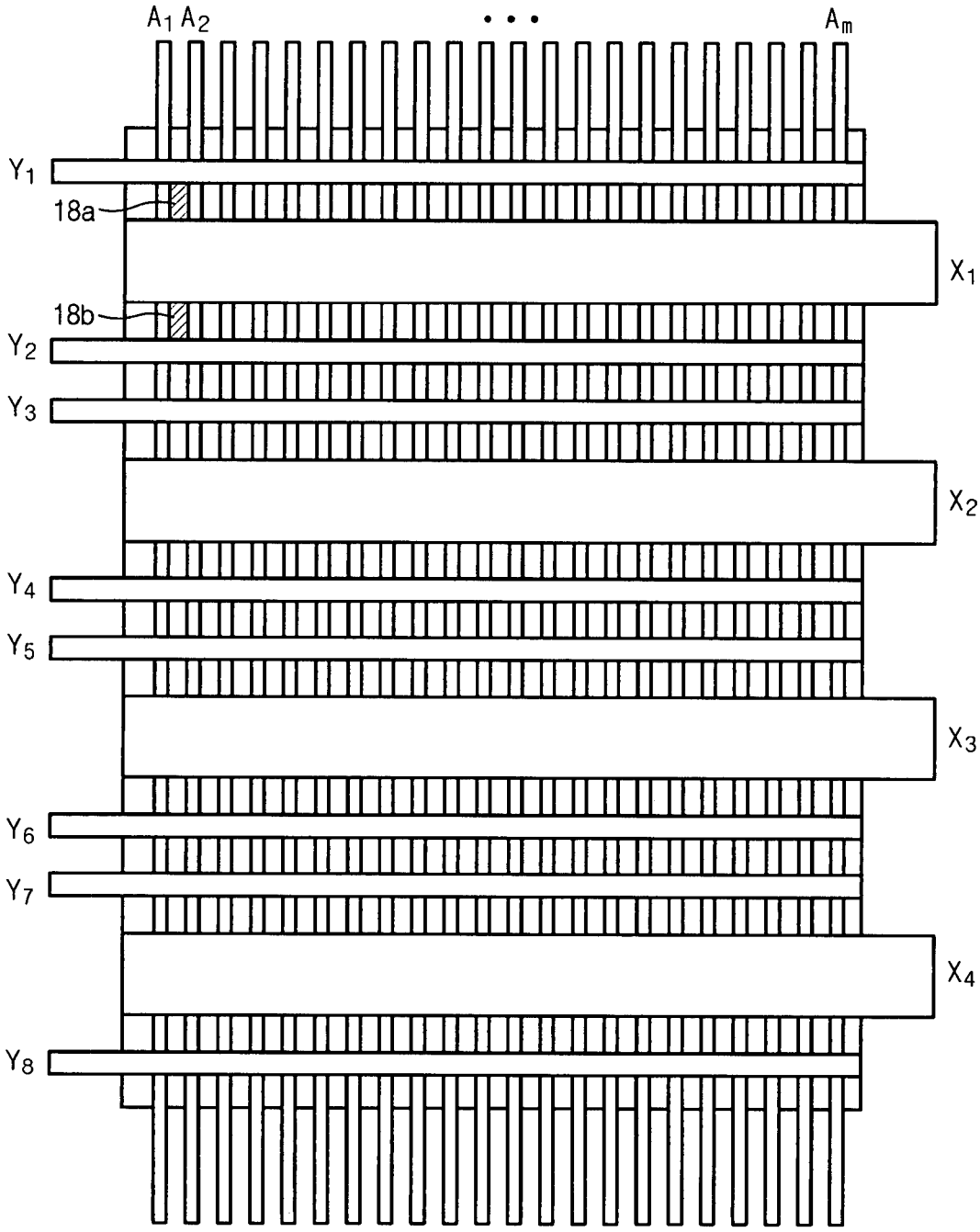
FIG. 3 shows a diagram of the control type PDP constructed as a second embodiment of discharge cell configuration according to the principles of the present invention.

In FIG. 3, two neighboring discharge cells 18*a* and 18*b* are denoted by respective reference numerals to compare configurations of the neighboring discharge cells. Y electrode Y1 is provided on the upper side of the upper discharge cell 18*a* and X electrode X1 is provided on the lower side of upper discharge cell 18*a*. Further, X electrode X1 is provided on the upper side of lower discharge cell 18*b* and Y electrode Y2 is provided on the lower side of lower discharge cell 18*b*. That is, the two neighboring cells may have the different electrode arrangement configurations.

Examples of the closed barrier rib configuration will be described with reference to FIG. 4 to FIG. 6.

Figure 4:
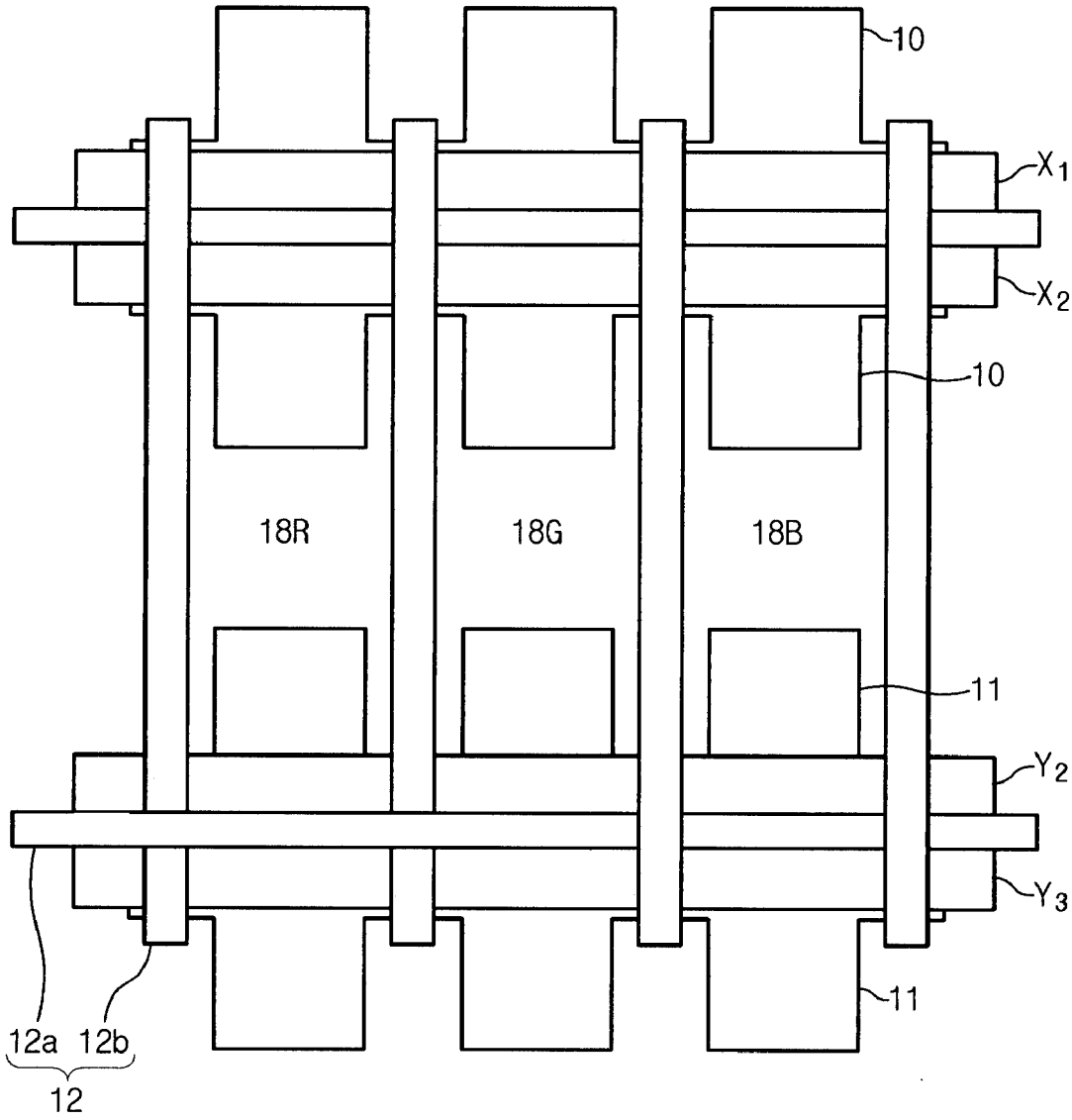
FIG. 4 shows a diagram of a closed barrier rib constructed as a first embodiment of closed barrier rib configuration according to the principles of the present invention.

FIG. 4 shows a diagram of a configuration of the closed barrier rib in the XXYY arrangement configuration constructed as a first embodiment of the closed barrier rib configuration according to the principles of the present invention.

As shown in FIG. 4, barrier rib 12 includes a first barrier rib member 12*a* formed in a row direction and a second barrier rib member 12*b* formed in a column direction. In this case, each of first barrier rib members 12*a* is formed to partition the column-wise neighboring discharge cells, and each second barrier rib member 12*b* is formed to partition the row-wise neighboring discharge cells.

Respective discharge cells 18R, 18G, and 18B are partitioned from each other by one first barrier rib member 12*a* and one second barrier rib member 12*b*. Phosphor layers for emitting visible light for each color are respectively formed in discharge cells 18R, 18G, and 18B partitioned by the barrier ribs. The discharge cells 18R, 18G, and 188B are classified as red discharge cells 18R, green discharge cells 18G, and blue discharge cells 188B according to the color of the phosphor layer. A combined discharge gas including neon and xenon is provided in the discharge cells 18R, 18G, and 18B constructed with the phosphor layer.

In addition, according to the XXYY arrangement configuration, either the pairs of X electrodes X1 and X2 or the pairs of Y electrodes Y2 and Y3 are arranged to correspond to one first barrier rib member 12*a*. Accordingly, the arranged X and Y electrodes are formed by a combination of bus electrodes (not shown) and transparent electrodes 10 and 11. In this case, transparent electrodes 10 and 11 of the X and Y electrodes protrude to face each other.

Another example of the closed barrier rib configuration will now be described with reference to FIG. 5. FIG. 5 shows a diagram of a configuration of the closed barrier rib constructed as a second embodiment of the closed barrier rib configuration according to the principles of the present invention.

Figure 5:
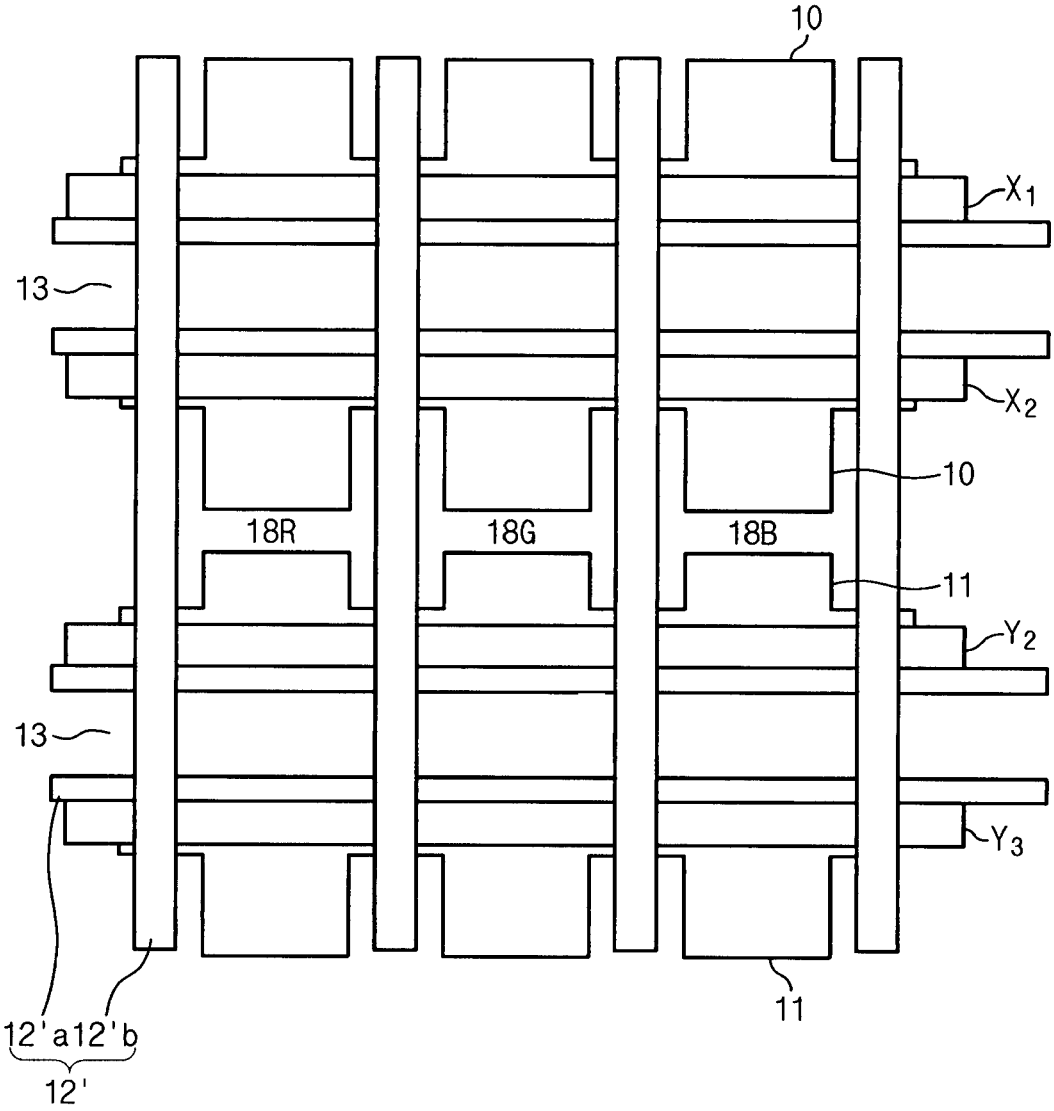
FIG. 5 shows a diagram of a closed barrier rib constructed as a second embodiment of closed barrier rib configuration according to the principles of the present invention.

As shown in FIG. 5, a barrier rib 12' includes a first barrier rib member 12*a*' formed in a row direction and a second barrier rib member 12*b*' formed in a column direction. In this case, pairs of first barrier rib members 12*a*' are formed so that first barrier rib members 12*a*' may not be shared by the column-wise neighboring discharge cells, and a channel 13 is formed to separate the two first barrier rib members.

Accordingly, two first barrier rib members 12*a*' partition the column-wise neighboring discharge cells, and one second barrier rib member 12*b* partitions the row-wise neighboring discharge cells. Therefore, the respective discharge cells 18R, 18G, and 18B are partitioned from each other by first barrier rib members 12*a* and second barrier rib members 12*b*.

As described, the phosphor layers for each color are respectively formed in the discharge cells 18R, 18G, and 18B partitioned by the barrier ribs. The discharge cells 18R, 18G, and 18B are classified as red discharge cells 18R, green discharge cells 18G, and blue discharge cells 18B according to the color of the phosphor layer. The combined discharge gas including neon and xenon is provided in the discharge cells 18R, 18G, and 18B constructed with the phosphor layer.

In addition, according to the XXYY arrangement configuration, the two neighboring X electrodes X1 and X2 and the two neighboring Y electrodes Y2 and Y3 are respectively arranged on the pairs of first barrier rib members 12*a*'. The arranged X and Y electrodes are formed by the combination of bus electrodes (not shown) and transparent electrodes 10 and 11. In this case, transparent electrodes 10 and 11 of the X and Y electrodes protrude to face each other.

A third example of the closed barrier rib will be described with reference to FIG. 6. FIG. 6 shows a configuration of the closed barrier rib according to a third embodiment of the closed barrier rib configuration according to the principles of the present invention.

Figure 6:
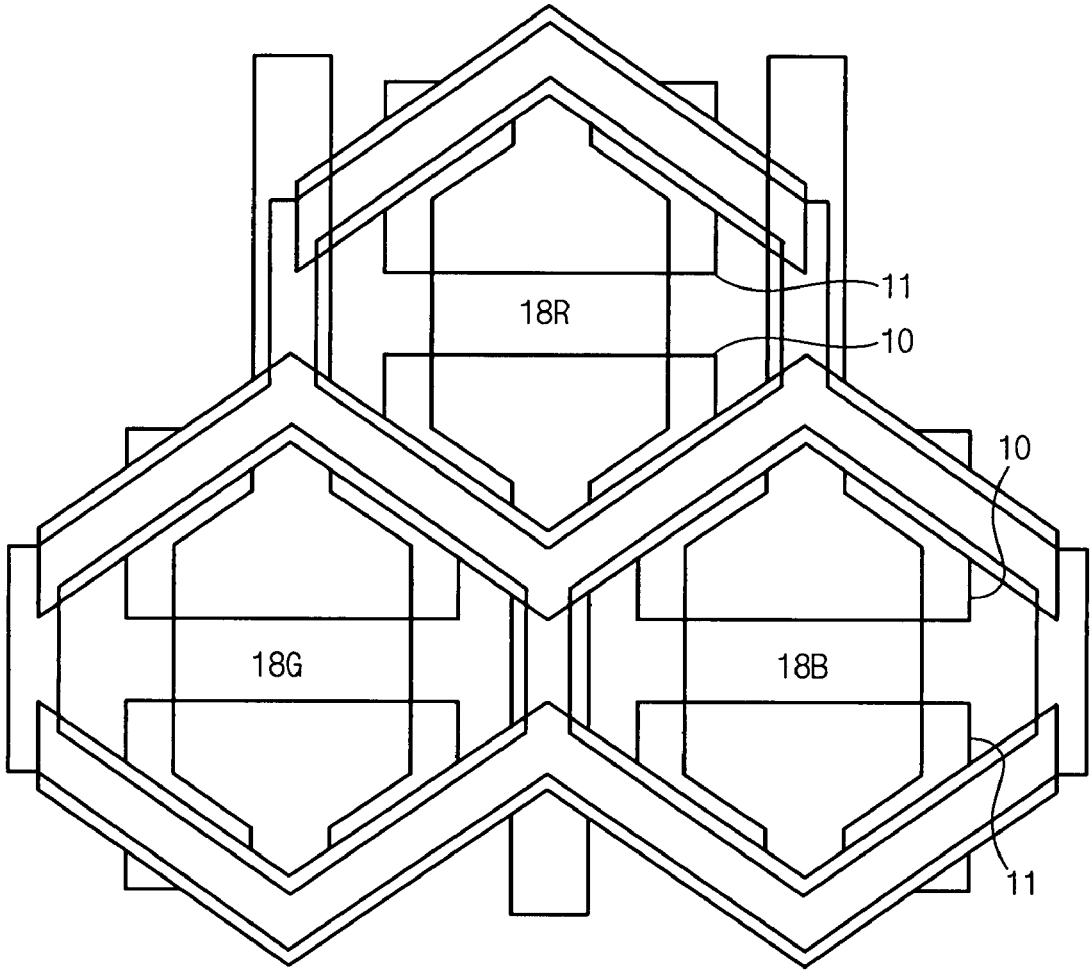
FIG. 6 shows a diagram of a closed barrier rib constructed as a third embodiment of closed barrier rib configuration according to the principles of the present invention.

The closed barrier rib configuration shown in FIG. 6 includes a hexagonal discharge cell, differing from those of FIG. 4 and FIG. 5. That is, the barrier rib includes six barrier rib members extending in six respective directions. The barrier rib is formed to partition neighboring discharge cells by the barrier rib member extending in one direction.

The respective discharge cells 18R, 18G, and 18B are partitioned from neighboring discharge cells by the six barrier rib members connected in a closed loop.

As described, the phosphor layers for each color are respectively formed in the discharge cells partitioned by the barrier ribs. The discharge cells are classified as red discharge cells 18R, green discharge cells 18G, and blue discharge cells 18B according to the color of the phosphor layer. The combined discharge gas including neon and xenon is provided in the discharge cells 18R, 18G, and 18B constructed with the phosphor layer.

Thereby, among the six barrier rib members forming one discharge cell, the X and Y electrodes are arranged on the four barrier rib members extending in a row direction.

The X and Y electrodes are formed by the combination of bus electrodes (not shown) and transparent electrodes 10 and 11. In this case, transparent electrodes 10 and 11 of the X and Y electrodes protrude to face each other.

Compared to a stripe barrier rib configuration, a plasma discharge is generated in a limited area partitioned by the barrier ribs. An area of the phosphor layer is wider in the discharge cell of the closed barrier rib configuration.

Figure 7:
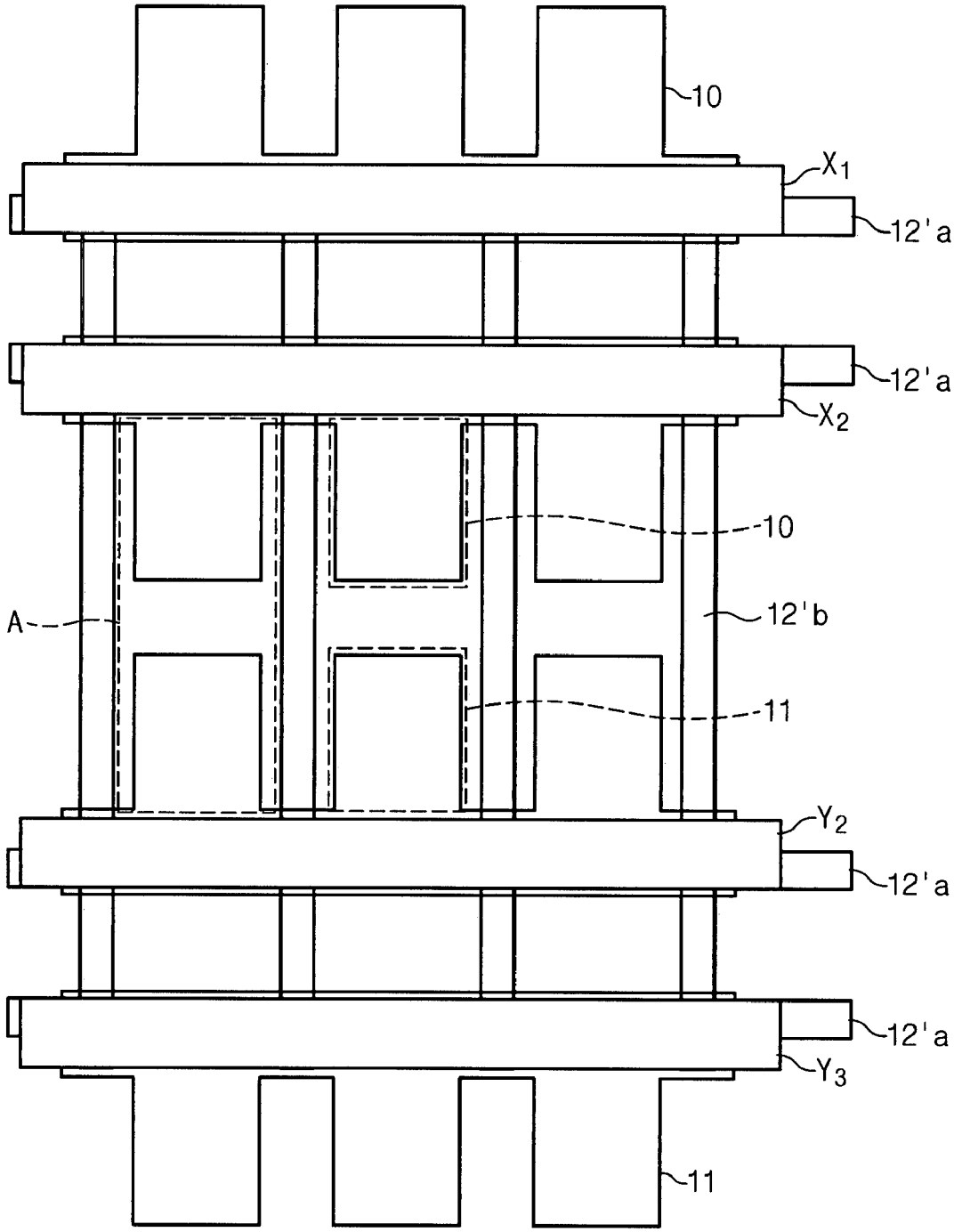
FIG. 7 shows a diagram representing an area of the sustain and scan electrodes of the control type PDP having no alignment error.

An area of the sustain and scan electrodes (i.e., a discharge area) in the discharge cell of the PDP without an alignment error will be described with reference to FIG. 7. FIG. 7 shows a diagram representing the area of the sustain and scan electrodes of the PDP without the alignment error.

As shown in FIG. 7, there is no alignment error when the bus electrodes of the X and Y electrodes are formed to correspond to first barrier rib member 12'*a* extending in a row direction.

When there is no alignment error, a space A partitioned by first barrier rib members 12'*a* in a row direction and second barrier rib members 12'*b* in a column direction is used as a discharge space. In this case, an effective area (hereinafter referred to as a "first area") of each of the transparent electrodes, i.e., the area that either transparent electrode 10 of the X electrode or transparent electrode 11 of the Y electrode that occupies discharge space A, is equal to an actual area (hereinafter referred to as a "second area") of transparent electrodes 10 or 11. That is, when there is no alignment error, the first areas of the X and Y electrodes for respective discharge cells are the same.

Accordingly, the scan pulse of the same width is applied to the respective discharge cells in the control type PDP having no alignment error during the address period. In this case, since the first areas of the X and Y electrodes are the same, a normal address discharge may be generated.

Figure 8:
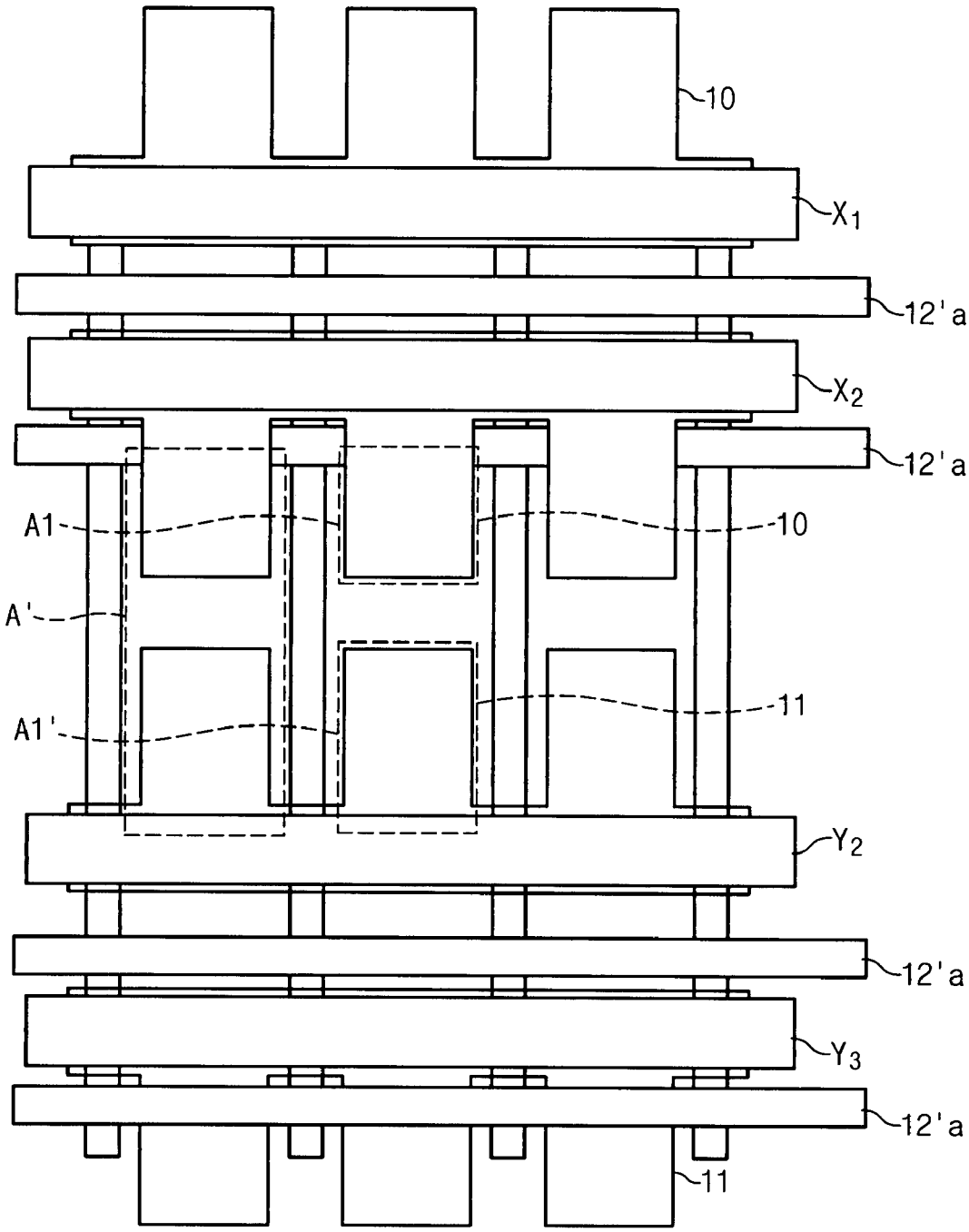
FIG. 8 shows a diagram representing the area of the sustain and scan electrodes in the control type PDP having the alignment error.

The area of the sustain and scan electrodes in the discharge cell of the control type PDP having the alignment error will be described with reference to FIG. 8. FIG. 8 shows a diagram representing the area of the sustain and scan electrodes in the control type PDP having the alignment error.

As shown in FIG. 8, the alignment error is generated when the bus electrodes of the X and Y electrodes are formed to deviate from the first barrier rib member 12'*a* extending in a row direction.

When the alignment error is generated, a aside length of discharge space A' of each discharge cell is reduced by the amount of the alignment error (i.e., a distance between the barrier rib member of the row direction and the X electrode (or the Y electrode)). Accordingly, a space A' reduced to be smaller than the discharge space A partitioned by the barrier ribs is used as a discharge space in the respective discharge cells. In this case, one of the first area of transparent electrode 10 of the X electrode and the first area of transparent electrode 11 of the Y electrode is equal to the second area, but the other first area is smaller than the second area. That is, as shown in FIG. 8, first area A1 of transparent electrode 10 of X electrode X2 is smaller than the second area (i.e., the actual area) of transparent electrode 10 of X electrode X2; whereas first area A1' of transparent electrode 11 of Y electrode Y2 is equal to the second area (i.e., the actual area) of transparent electrode 11 of Y electrode Y2.

Figure 9:
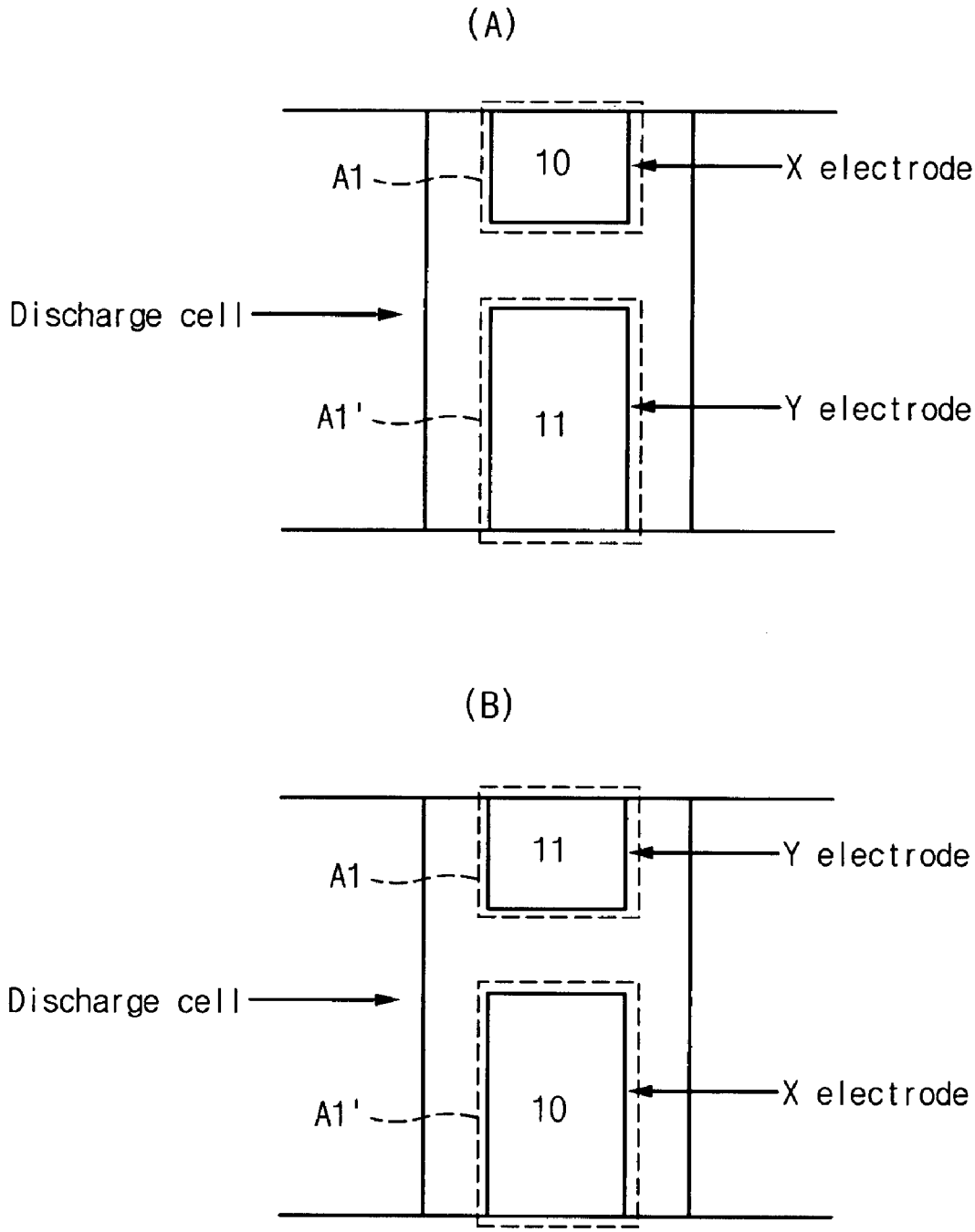
FIG. 9 shows a diagram of an electrode configuration of two neighboring discharge cells in the control type PDP having the alignment error.

Accordingly, when the alignment error is generated, as shown in FIG. 8 and FIG. 9(*a*), first area A1 of transparent electrode 10 of the X electrode is smaller than the second area of transparent electrode 10 of the X electrode in first discharge cell A', and first area A1' of transparent electrode 11 of the Y electrode is equal to the second area of transparent electrode 11 of the Y electrode. In addition, in a second discharge cell which is a column-wise neighbor of the first discharge cell as shown in FIG. 9(*b*), first area A1 of transparent electrode 10 of the X electrode is equal the second area of transparent electrode 10 of the X electrode, and first area A1' of transparent electrode 11 of the Y electrode is smaller than the second area of transparent electrode 11 of the Y electrode.

That is, since the first area of the even line Y electrode is equal to the second area of the even line Y electrode when the first area of the odd line Y electrode is smaller than the second area of the odd line Y electrode, the first areas of the odd and even line Y electrodes are different.

Therefore, when the address discharge which is determined by a voltage difference between the scan pulse applied to the Y electrode and the address pulse applied to the A electrode, is generated, a low discharge or a misfire may be generated in the odd or even line in which the first area of the Y electrode is smaller than the second area of the Y electrode.

Hereinafter, a method for solving the low address discharge or the misfire generated in one of the odd and even lines will be described with reference to FIG. 9 and FIG. 10.

FIG. 9 shows a diagram of an electrode configuration of two neighboring discharge cells in the PDP having the alignment error. In further detail, FIG. 9(*a*) shows an odd line discharge cell configuration and FIG. 9(*b*) shows an even line discharge cell configuration. Hereinafter, the discharge cell of the odd line shown in FIG. 9(*a*) will be referred to as an A type discharge cell, and the discharge cell of the even line shown in FIG. 9(*b*) will be referred to as a B type discharge cell.

In the A type discharge cell as shown in FIG. 9(*a*), first area A1' of the Y electrode is equal to an actual area (i.e., the second area) of the Y electrode. In the B type discharge cell as shown in FIG. 9(*b*), first area A1' of the Y electrode is smaller than the second area of the Y electrode.

A first embodiment of driving method of the plasma display according to the principles of the present invention will be described with reference to FIG. 10. FIG. 10 shows a driving waveform diagram representing the driving method in a progressive scan method of the plasma display according to the first exemplary embodiment of the present invention when the first area of the Y electrode of the discharge cell positioned in the even line is smaller than the second area of the Y electrode of the discharge cell positioned in the even line. For better understanding and ease of description, one subfield among the plurality of subfields is illustrated, and detailed descriptions of the voltage waveform applied to the X electrode will be omitted since the voltage waveform applied to the X electrode is the same as when there is no alignment error. In addition, since the address pulse is applied to the Y electrode during the address period, detailed descriptions thereof will be omitted.

When the alignment error is generated between the Y and X electrodes in the control type PDP, controller 200 outputs the scan electrode driving control signal for solving the low discharge or the misfire for the even line during the address period along with the sustain electrode driving control signal and the address driving control signal.

Figure 10:
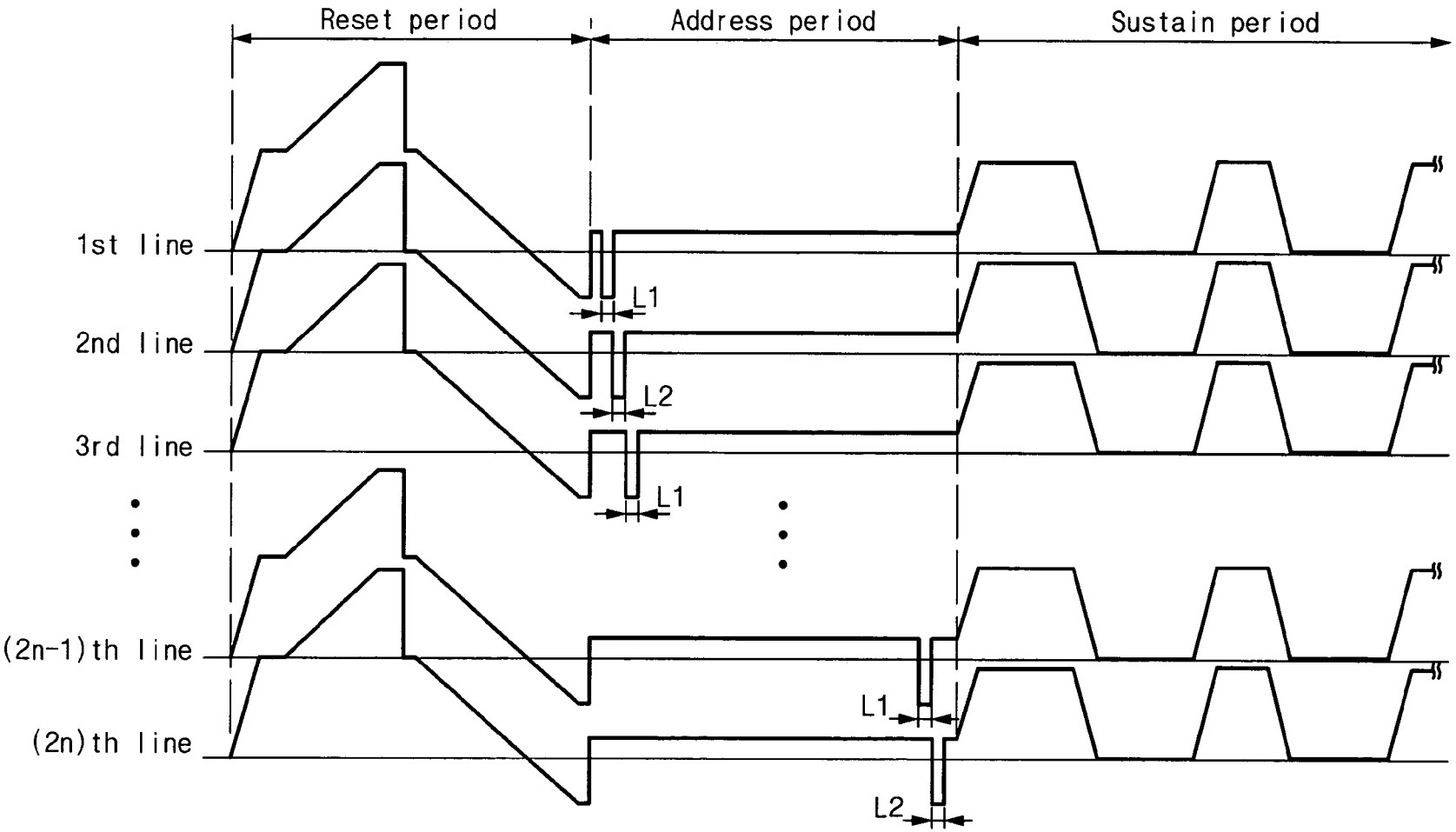
FIG. 10 shows a driving waveform diagram for driving the plasma display according to a first embodiment of the driving method according to the principles of the present invention.

Scan electrode driver 400 and sustain electrode driver 500 output the driving waveforms shown in FIG. 10.

As shown in FIG. 10, the driving waveforms corresponding to the reset period, the address period, and the sustain period are applied to the plurality of Y electrodes. A reset waveform for initializing all the discharge cells or the discharge cell discharged in a previous subfield is applied during the reset period, and a sustain pulse alternately having a high level voltage and a low level voltage is applied during the sustain period.

The scan pulse is sequentially applied to the Y electrodes from a first scan line to a last scan line during the address period.

In this case, a width L2 of the scan pulse applied to the Y electrode in an even scan line (even-numbered Y electrode) among the plurality of scan lines is greater than a width L1 of the scan pulse applied to the Y electrode in an odd scan line (odd-numbered Y electrode). In further detail, when there is no alignment error, width L1 of the scan pulse applied to the Y electrodes in the odd scan lines is the same as width L2 of the scan pulse applied to the Y electrodes in the even scan lines of the control type PDP during the address period. When there is an alignment error, however, width L2 of the scan pulse applied to the Y electrodes in the even scan lines is greater than width L1 of the scan pulse applied to the Y electrodes in the odd scan lines of the control type PDP during the address period. Here, width L2 of the scan pulse applied to the even scan line is in direct proportion to the size of the alignment error.

Accordingly, in the odd scan line, since the first area of the Y electrode is the same as the second area (i.e., the normal size) of the Y electrode, and the area of the A electrode is the normal size, the normal address discharge corresponding to the scan pulse of the width L1 may be applied.

In addition, in the even scan line, since the first area of the Y electrode is smaller than the second area (i.e., the normal size) of the Y electrode, the scan pulse having the width L2 increased to be wider than width A is applied and the address pulse (not shown) having width L2 is applied in correspondence to the scan pulse of width L2, and therefore the low discharge or the misfire problem may be solved by a voltage applying time corresponding to the width L2.

Figure 11:
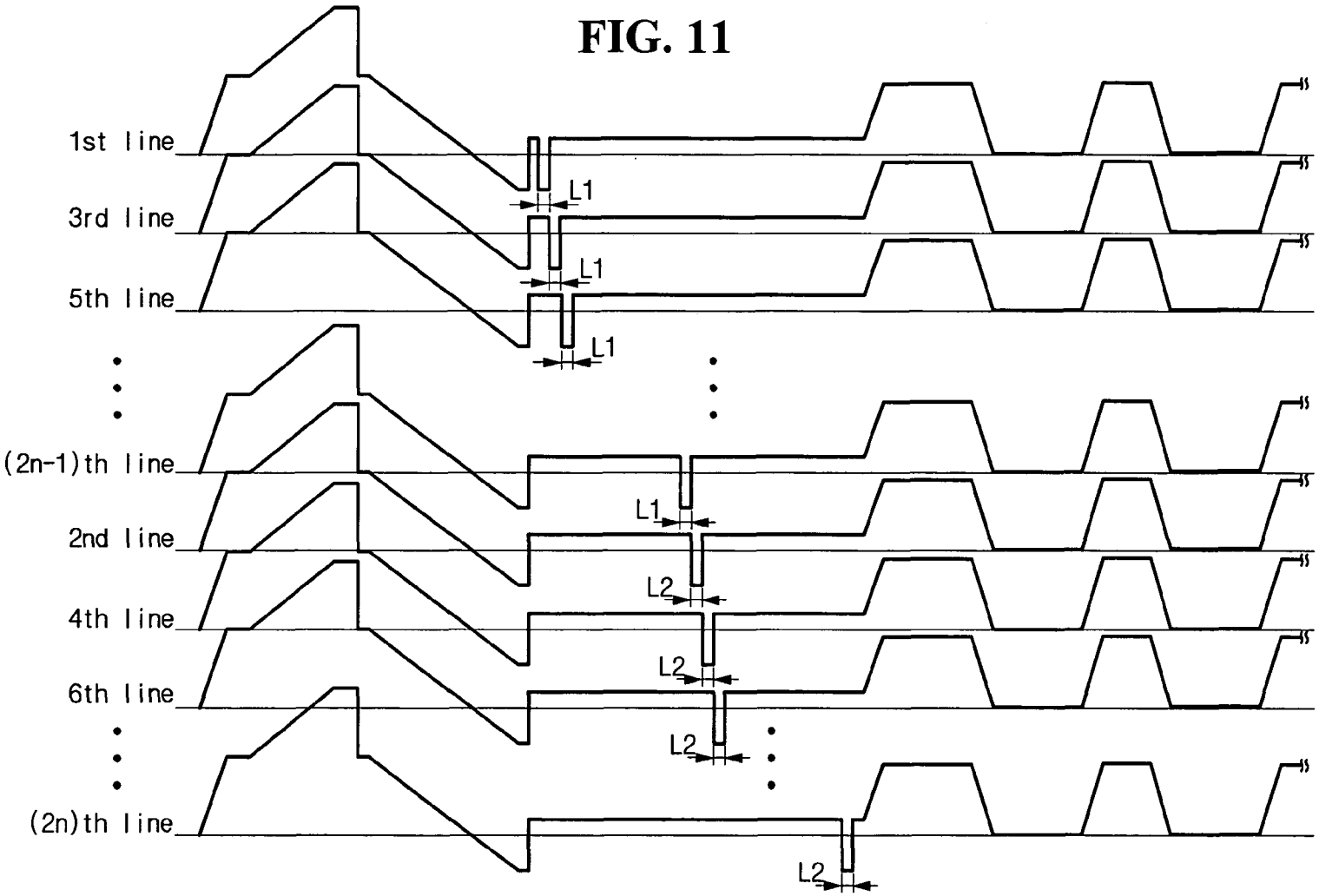
FIG. 11 shows a driving waveform diagram for driving the plasma display according to a second embodiment of the driving method according to the principles of the present invention.

A second embodiment of the driving method of the plasma display according to the principles of the present invention will be described with reference to FIG. 11. FIG. 11 shows a driving waveform diagram representing the driving method in an interlace scan method of the plasma display according to the second exemplary embodiment of the present invention when the first area of the Y electrode in the discharge cell positioned in the even line is smaller than the second area of the Y electrode in the discharge cell positioned in the even line. For better understanding and ease of description, one subfield among the plurality of subfields is illustrated, and detailed descriptions of the voltage waveform applied to the X electrode will be omitted since it is the same as when there is no alignment error. In addition, since the address pulse is applied to the Y electrode during the address period in correspondence to the Y electrode, detailed descriptions thereof will be omitted.

As shown in FIG. 11, the driving method according to the second embodiment of the driving method of the present invention is the same as that of the first exemplary embodiment of the present invention except that the odd scan lines are scanned first and the even scan lines are subsequently scanned. That is, in a like manner of the first exemplary embodiment of the present invention, the width L2 of the scan pulse applied to the even scan lines among the plurality of scan lines is increased to be wider than the width L1 of the scan pulse applied to the odd scan line in the second embodiment of the present invention.

Therefore, according to the second exemplary embodiment of the present invention, in the odd scan lines, since the first area of the Y electrode is the same as the second area (i.e., the normal size) of the Y electrode, and the area of the A electrode is the normal size, the normal address discharge is generated in correspondence to the scan pulse having the width L1.

In addition, in the even scan line, since the first area of the Y electrode is smaller than the second area (i.e., the normal size) of the Y electrode, the scan pulse having the width L2 increased to be wider than the width L1 is applied, and the address pulse (not shown) having the width B is applied in correspondence to the scan pulse of the width B, and therefore, the low discharge or the misfire problem may be solved by a voltage applying time corresponding to the width B.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

According to the exemplary embodiment of the present invention, the low discharge or the misfire generated in the odd or even discharge cell by the alignment error of the X and Y electrodes during the address period may be solved.

What is claimed is:

1. A driving method for a plasma display, with the plasma display having a closed barrier rib configuration and comprising a plurality of first and second electrodes, a plurality of third electrodes formed crossing the first and second electrodes, and a plurality of discharge cells formed at crossing regions of the first, second, and third electrodes, with the driving method comprising:

during an address period of a subfield, applying a scan pulse having a first width to odd-numbered first electrodes; and applying a scan pulse having a second width that is different from the first width to the even-numbered first electrodes, the second width being wider than the first width when an area of an odd-numbered first electrode within a discharge cell is greater than an area of an even-numbered first electrode within the discharge cell.

2. The driving method of claim 1, comprised of the applying of the scan pulse having the first width and the applying of the scan pulse having the second width being performed when the plasma display has an alignment error between the barrier rib configuration and the first and second electrodes.

3. The driving method of claim 1, wherein the first and second widths being determined in dependence upon the area of the odd-numbered first electrode in the discharge cell and the area of the even-numbered first electrode in the discharge cell.

4. The driving method of claim 3, comprised of the first width being the same as a width of the scan pulse applied to the first electrode of the Plasma display having no alignment error.

5. The driving method of claim 3, comprised of the second width increasing as the area of the even-numbered first electrode in the discharge cell decreases.

6. A plasma display, comprising:

a plasma display panel having a closed barrier rib configuration comprising a plurality of first and second electrodes, a plurality of third electrodes formed crossing the first and second electrodes, and a plurality of discharge cells formed at crossing regions of the first, second, and third electrodes, a controller dividing one frame into a plurality of subfields and driving the subfields, with each subfield comprising a reset period, an address period, and a sustain period, and driving the subfields; and a first electrode driver for generating scan pulses according to a control operation of the controller, and applying the scan pulses to the plurality of first electrodes during the address period, with the first electrode driver applying the scan pulses having a first width among the scan pulses to odd-numbered first electrodes, and applying the scan pulses having a second width that is different from the first width to even-numbered first electrodes, the second width being wider than the first width when an area of an odd-numbered first electrode within a discharge cell is greater than an area of an even-numbered first electrode within the discharge cell.

7. The plasma display of claim 6, the application of the scan pulses having the first width to odd-numbered first electrodes and scan pulses having the second and different width to even-numbered first electrodes is to compensate for an alignment error between the barrier rib configuration and the first and second electrodes.

8. The plasma display of claim 6, wherein the first and second widths being determined in dependence upon the area of the odd-numbered first electrode in the discharge cell and the area of the even-numbered first electrode in the discharge cell.

9. The plasma display of claim 8, comprised of the first width being the same as a width of the scan pulse applied to the first electrode of the Plasma display panel having no alignment error.

10. The plasma display of claim 8, comprised of the second width increasing as the area of the even-numbered first electrode in the discharge cell decreases.

* * * * *